US009371966B2

(12) United States Patent
Rowlette, Jr. et al.

(10) Patent No.: US 9,371,966 B2
(45) Date of Patent: Jun. 21, 2016

(54) LIGHTING FIXTURE

(75) Inventors: John R. Rowlette, Jr., Raleigh, NC (US); Craig William Hardin, Apex, NC (US); Scott Schwab, Durham, NC (US)

(73) Assignee: Cree, Inc., Durham, NC (US)

( * ) Notice: Subject to any disclaimer, the term of this patent is extended or adjusted under 35 U.S.C. 154(b) by 877 days.

(21) Appl. No.: 13/042,378

(22) Filed: Mar. 7, 2011

(65) Prior Publication Data

US 2012/0140465 A1 Jun. 7, 2012

Related U.S. Application Data

(60) Provisional application No. 61/419,415, filed on Dec. 3, 2010, provisional application No. 61/413,949, filed on Nov. 15, 2010.

(51) Int. Cl.

| | |
|---|---|
| ***F21V 29/71*** | (2015.01) |
| ***F21K 99/00*** | (2016.01) |
| ***F21S 8/02*** | (2006.01) |
| ***F21V 21/04*** | (2006.01) |
| ***F21V 29/00*** | (2015.01) |
| ***F21V 29/77*** | (2015.01) |
| *F21Y 101/02* | (2006.01) |

(Continued)

(52) U.S. Cl.

CPC ... *F21K 9/00* (2013.01); *F21S 8/02* (2013.01); *F21S 8/026* (2013.01); *F21V 21/04* (2013.01); *F21V 29/004* (2013.01); *F21V 29/773* (2015.01); *F21V 29/86* (2015.01); *F21V 29/89* (2015.01); *F21Y 2101/02* (2013.01)

(58) Field of Classification Search

USPC ..... 362/147, 364

See application file for complete search history.

(56) References Cited

U.S. PATENT DOCUMENTS

| | | | |
|---|---|---|---|
| 1,099,061 | A | 6/1914 | Lane |
| D47,607 | S | 7/1915 | Owen |
| 1,230,844 | A | 6/1917 | Blair |

(Continued)

FOREIGN PATENT DOCUMENTS

| | | |
|---|---|---|
| CN | 3557377 | 8/2006 |
| EM | 000380670-001 | 8/2005 |

(Continued)

OTHER PUBLICATIONS

Quayle Action for U.S. Appl. No. 29/379,154 mailed May 30, 2012, 11 pages.

(Continued)

*Primary Examiner* — Julie Bannan

(74) *Attorney, Agent, or Firm* — Withrow & Terranova, P.L.L.C.

(57) ABSTRACT

The present disclosure relates to a lighting fixture that is configured to transfer heat that is generated by a light source and any associated electronics toward the front of the lighting fixture. The lighting fixture includes a heat spreading cup that is formed from a material that efficiently conducts heat and a light source that is coupled inside the heat spreading cup. The heat spreading cup has a bottom panel, a rim, and at least one sidewall extending between the bottom panel and the rim. The light source is coupled inside the heat spreading cup to the bottom panel and configured to emit light in a forward direction through an opening formed by the rim. Heat generated by the light source during operation is transferred radially outward along the bottom panel and in a forward direction along the at least one sidewall toward the rim of the heat spreading cup.

30 Claims, 14 Drawing Sheets

(51) Int. Cl.
*F21V 29/85* (2015.01)
*F21V 29/89* (2015.01)

(56) References Cited

U.S. PATENT DOCUMENTS

D109,740 S 5/1938 Stewart
D134,595 S 12/1942 Van Es
D158,821 S 5/1950 Walter
2,640,148 A 5/1953 McCandless
D199,141 S 9/1964 Curry
D231,679 S 5/1974 Keller
D231,680 S 5/1974 Keller
D238,185 S 12/1975 Wellward et al.
5,034,869 A 7/1991 Choi
5,103,381 A 4/1992 Uke
D325,999 S 5/1992 Sonneman
D326,537 S 5/1992 Gattari
D341,442 S 11/1993 Shapiro
5,477,441 A 12/1995 Budnovitch et al.
D375,605 S 11/1996 Balish, Jr.
D383,564 S 9/1997 Lecluze
5,664,869 A 9/1997 Bitton
D386,805 S 11/1997 Bonnette et al.
D392,764 S 3/1998 Balish, Jr.
D397,472 S 8/1998 Lecluze
D399,021 S 9/1998 Lam
5,800,038 A * 9/1998 McCool ..... 362/475
D399,590 S 10/1998 Lecluze
D400,274 S 10/1998 Ziaylek, Jr. et al.
D411,640 S 6/1999 Lueken et al.
D413,997 S 9/1999 Jandrisits et al.
D421,316 S 2/2000 Fiorato
D433,179 S 10/2000 Johnson
6,152,582 A 11/2000 Klaus
6,193,392 B1 * 2/2001 Lodhie ..... 362/235
D457,677 S 5/2002 Landefeld et al.
D459,504 S 6/2002 Chen
D468,044 S 12/2002 Lam
6,491,407 B1 12/2002 Beadle
D468,477 S 1/2003 Landefeld et al.
D473,966 S 4/2003 Lecluze
D474,298 S 5/2003 Lecluze
6,644,834 B2 11/2003 Christen
D488,251 S 4/2004 Benghozi
D488,583 S 4/2004 Benghozi
D506,280 S 6/2005 Chen
6,913,371 B2 7/2005 Ping
D508,141 S 8/2005 Rashidi
D508,750 S 8/2005 Rashidi
D509,017 S 8/2005 Rashidi
D509,615 S 9/2005 Rashidi
6,948,829 B2 9/2005 Verdes et al.
D544,979 S 6/2007 Hartmann, Jr. et al.
D547,484 S 7/2007 Guercio
D548,390 S 8/2007 Lecluze
D549,384 S 8/2007 Grawunder
D558,377 S 12/2007 Rashidi
D558,378 S 12/2007 Rashidi
D560,204 S 1/2008 Bhavnani
D561,374 S 2/2008 Hartmann, Jr. et al.
D570,515 S 6/2008 Flaherty et al.
D574,104 S 7/2008 Sanoner
7,396,146 B2 7/2008 Wang
D588,296 S 3/2009 Sabernig
D588,735 S 3/2009 Woodard
D591,894 S 5/2009 Flank
7,549,772 B2 6/2009 Wang
D596,334 S 7/2009 Sabernig
7,614,769 B2 * 11/2009 Sell ..... 362/365
D606,696 S 12/2009 Chen et al.
D607,140 S 12/2009 Farris et al.
7,631,987 B2 12/2009 Wei
D608,044 S 1/2010 Pickett
D609,840 S 2/2010 Tang
D610,292 S 2/2010 Yoshinobu et al.
7,677,767 B2 3/2010 Chyn
D614,337 S 4/2010 Robinson et al.
D617,934 S 6/2010 Rashidi
D622,434 S 8/2010 Ward et al.
7,771,086 B2 8/2010 Goverde
7,789,535 B2 9/2010 Wang et al.
D625,876 S 10/2010 Chen et al.
D625,879 S 10/2010 Sabernig
D626,676 S 11/2010 Johnson
D628,733 S 12/2010 Cobb, III et al.
7,862,214 B2 1/2011 Trott et al.
D632,822 S 2/2011 Bitton
D646,429 S 10/2011 Sabernig
8,104,928 B1 * 1/2012 Horn ..... 362/287
D656,263 S 3/2012 Ogawa et al.
8,240,871 B2 8/2012 Chou
D671,668 S 11/2012 Rowlette, Jr. et al.
D672,899 S 12/2012 Van De Ven et al.
D674,127 S 1/2013 Rowlette, Jr. et al.
D692,171 S 10/2013 Randolph et al.
D694,456 S 11/2013 Rowlette, Jr. et al.
D695,941 S 12/2013 Rashidi
8,907,550 B2 * 12/2014 Zaderej ..... F21K 9/00 313/46
2004/0050538 A1 3/2004 Sunder et al.
2005/0111234 A1 5/2005 Martin et al.
2006/0245184 A1 11/2006 Galli
2006/0263547 A1 11/2006 Cojocariu et al.
2007/0019409 A1 1/2007 Nawashiro et al.
2007/0035951 A1 * 2/2007 Tseng ..... 362/294
2007/0041220 A1 * 2/2007 Lynch ..... 362/646
2008/0074889 A1 * 3/2008 Gloisten et al. ..... 362/341
2008/0117637 A1 5/2008 Chang et al.
2008/0158887 A1 * 7/2008 Zhu et al. ..... 362/294
2009/0086492 A1 4/2009 Meyer
2009/0161356 A1 * 6/2009 Negley ..... H05B 33/0803 362/231
2009/0219727 A1 9/2009 Weaver
2009/0283779 A1 11/2009 Negley et al.
2010/0061076 A1 3/2010 Mandy et al.
2010/0110699 A1 5/2010 Chou
2010/0164348 A1 * 7/2010 Huang et al. ..... 313/46
2010/0177509 A1 7/2010 Pickard
2010/0226139 A1 * 9/2010 Lynch et al. ..... 362/373
2010/0296272 A1 * 11/2010 Roos et al. ..... 362/147
2011/0002124 A1 1/2011 Chang et al.
2011/0026261 A1 2/2011 Kuan
2011/0255292 A1 10/2011 Shen
2012/0044704 A1 2/2012 Wilson et al.
2012/0051068 A1 3/2012 Pelton et al.
2012/0140490 A1 6/2012 Rowlette, Jr. et al.
2012/0230028 A1 9/2012 Foo
2013/0027938 A1 * 1/2013 Hisayasu ..... F21K 9/135 362/249.02
2013/0051012 A1 2/2013 Oehle et al.
2013/0141918 A1 6/2013 Harbers et al.
2013/0214665 A1 * 8/2013 Nezu ..... F21K 9/1355 313/46
2014/0003061 A1 1/2014 Chen et al.
2014/0292194 A1 * 10/2014 Sagal ..... F21K 9/1355 315/34
2015/0043216 A1 * 2/2015 Du ..... F21V 29/508 362/296.01
2015/0062917 A1 3/2015 Yin

FOREIGN PATENT DOCUMENTS

FR 2909160 A1 5/2008
WO 2008036596 A1 3/2008
WO 2008061082 A2 5/2008
WO 2008067447 A1 6/2008
WO 2009111905 A1 9/2009
WO 2011037878 A1 3/2011

OTHER PUBLICATIONS

International Search Report for PCT/US2011/062990 mailed Apr. 12, 2012, 10 pages.

(56) References Cited

OTHER PUBLICATIONS

International Search Report for PCT/US2011/062992 mailed Apr. 2, 2012, 12 pages.
Notice of Allowance for U.S. Appl. No. 29/379,154 mailed Aug. 13, 2012, 7 pages.
First Office Action for Chinese Patent Application No. 201280023405.6, issued Dec. 9, 2014, 17 pages.
First Office Action for Chinese Patent Application No. 201180058225.7, issued Dec. 17, 2014, 29 pages.
Second Office Action for Chinese Patent Application No. 201180058225.7, mailed Oct. 23, 2015, 24 pages.
Examination Report for German Patent Application No. 112012005131.9, mailed Aug. 5, 2015, 18 pages.
International Preliminary Report on Patentability for PCT/US2012/067754, mailed Jun. 19, 2014, 8 pages.
Notice of Allowance for U.S. Appl. No. 29/456,927, mailed Sep. 18, 2013, 8 pages.
Non-Final Office Action for U.S. Appl. No. 13/042,388, mailed Oct. 18, 2013, 12 pages.
Notice of Allowance for U.S. Appl. No. 29/408,234, mailed Mar. 14, 2014, 5 pages.
Non-Final Office Action for U.S. Appl. No. 14/073,446, mailed Nov. 17, 2015, 9 pages.
Notice of Allowance for U.S. Appl. No. 29/469,362, mailed Mar. 25, 2014, 5 pages.
Quayle Action for U.S. Appl. No. 13/042,388, mailed May 27, 2014, 4 pages.
Notice of Allowance for U.S. Appl. No. 13/042,388, mailed Jul. 21, 2014, 7 pages.
Non-final Office Action for U.S. Appl. No. 13/649,531, mailed Jul. 31, 2014, 7 pages.
Final Office Action for U.S. Appl. No. 13/649,531, mailed Dec. 16, 2014, 7 pages.
Non-Final Office Action for U.S. Appl. No. 13/649,531, mailed Jun. 4, 2015, 9 pages.
Final Office Action for U.S. Appl. No. 13/649,531, mailed Oct. 8, 2015, 8 pages.
Advisory Action for U.S. Appl. No. 13/649,531, mailed Dec. 24, 2015, 3 pages.
Non-Final Office Action for U.S. Appl. No. 14/073,428, mailed Jan. 11, 2016, 11 pages.
Restriction Requirement for U.S. Appl. No. 29/408,232 mailed Jan. 16, 2013, 5 pages.
International Search Report for PCT/US2012/067754 mailed Feb. 20, 2013, 11 pages.
Notice of Allowance and Examiner-Initiated Interview Summary for U.S. Appl. No. 14/073,446, mailed Apr. 1, 2016, 9 pages.
First Examination Report for European Patent Application No. 11793990.0, mailed Apr. 5, 2016, 7 pages.

* cited by examiner

LIGHTING FIXTURE

RELATED APPLICATIONS

This application claims the benefit of U.S. Provisional Patent Application No. 61/419,415, filed Dec. 3, 2010 and U.S. Provisional Patent Application No. 61/413,949 filed Nov. 15, 2010, the disclosures of which are incorporated herein by reference in their entireties. This application is related to concurrently filed U.S. Utility patent application Ser. No. 13/042,388, now U.S. Pat. No. 8,894,253, entitled HEAT TRANSFER BRACKET FOR LIGHTING FIXTURE, the disclosure of which is incorporated herein by reference in its entirety.

FIELD OF THE DISCLOSURE

The present disclosure relates to lighting fixtures.

BACKGROUND

In recent years, a movement has gained traction to replace incandescent light bulbs with lighting fixtures that employ more efficient lighting technologies. One such technology that shows tremendous promise employs light emitting diodes (LEDs). Compared with incandescent bulbs, LED-based light fixtures are much more efficient at converting electrical energy into light and are longer lasting, and as a result, lighting fixtures that employ LED technologies are expected to replace incandescent bulbs in residential, commercial, and industrial applications.

Unlike incandescent bulbs that operate by subjecting a filament to a desired current, LED-based lighting fixtures require control electronics to drive one or more LEDs. The control electronics includes a power supply and circuitry to provide the pulse streams or other signals that are required to drive the one or more LEDs in a desired fashion. While much more efficient than incandescent bulbs, the control electronics and the LEDs of the lighting fixture will emit a certain amount of heat, which should be efficiently dissipated to avoid damaging or reducing the operating life of the control electronics or the LEDs.

Since the control electronics and the LEDs of an LED-based lighting fixture are often mounted in such a way to allow the LED-based lighting fixture to replace either an incandescent light bulb or a lighting fixture that is compatible with an incandescent bulb, the control electronics and LEDs are often mounted in a location that is not conducive for heat dissipation. As such, there is a need to efficiently and effectively dissipate heat that is generated by the control electronics, the LEDs, or a combination thereof in LED-based lighting fixtures as well as other types of lighting fixtures that are faced with similar heat dissipation needs.

SUMMARY

The present disclosure relates to a lighting fixture that is configured to transfer heat that is generated by the light source and any associated electronics toward the front of the lighting fixture. In one embodiment, the lighting fixture includes a heat spreading cup that is formed from a material that efficiently conducts heat and a light source that is coupled inside the heat spreading cup. The heat spreading cup has a bottom panel, a rim, and at least one sidewall extending between the bottom panel and the rim. The light source is coupled inside the heat spreading cup to the bottom panel and configured to emit light in a forward direction through an opening formed by the rim. The light source is thermally coupled to the bottom panel such that heat generated by the light source during operation is transferred radially outward along the bottom panel and in a forward direction along the at least one sidewall toward the rim of the heat spreading cup.

The lighting fixture may optionally include a lens assembly and a reflector. The lens assembly is coupled to the heat spreading cup and covers the opening provided by the rim. The reflector has a body extending between a smaller opening, which is substantially adjacent and open to the light emitting element of the light source, and a larger opening that is biased toward the opening formed by the rim. To control the light source, a control module may be coupled to an exterior surface of the bottom panel. The control module is thermally coupled to the exterior surface of the bottom panel such that heat generated by the electronics during operation is transferred radially outward along the bottom panel and in a forward direction along the at least one sidewall toward the rim. In certain embodiments, a majority of the heat that is generated from the electronics and light emitting source and transferred to the bottom panel is transferred radially outward along the bottom panel and in a forward direction along the at least one sidewall toward the rim.

BRIEF DESCRIPTION OF THE DRAWINGS

The accompanying drawings incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not particularly addressed herein. It should be understood that these concepts and applications fall within the scope of the disclosure.

It will be understood that relative terms such as "front," "forward," "rear," "below," "above," "upper," "lower," "horizontal," or "vertical" may be used herein to describe a relationship of one element, layer or region to another element, layer or region as illustrated in the figures. It will be understood that these terms are intended to encompass different orientations of the device in addition to the orientation depicted in the figures.

Figure 1:
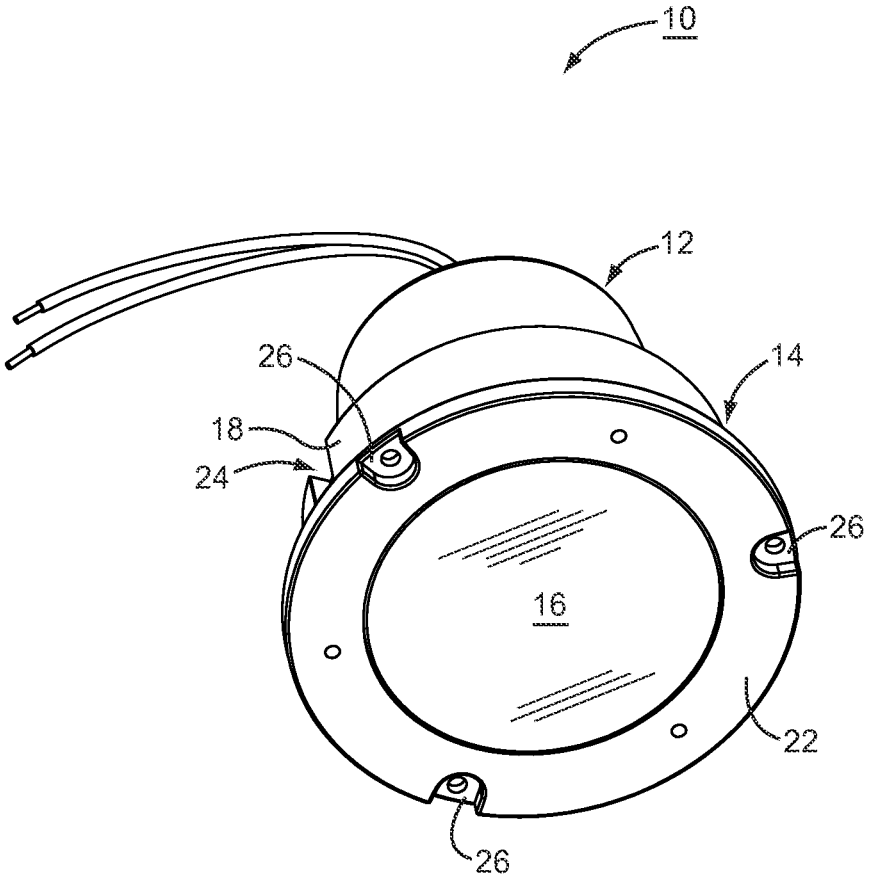
FIG. 1 is an isometric view of the front of the lighting fixture according to one embodiment of the disclosure.
Figure 2:
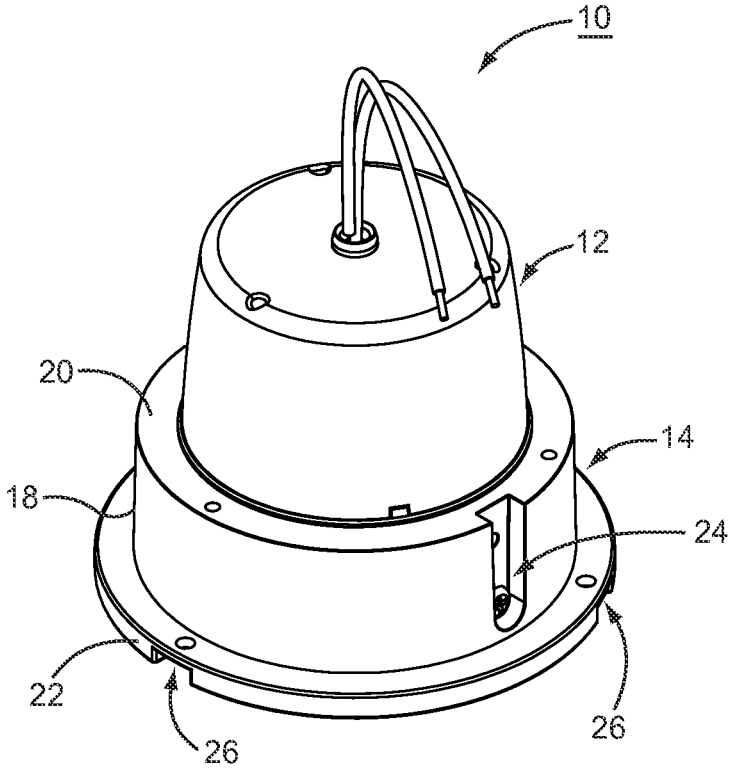
FIG. 2 is an isometric view of the back of the lighting fixture of FIG. 1.
Figure 3:
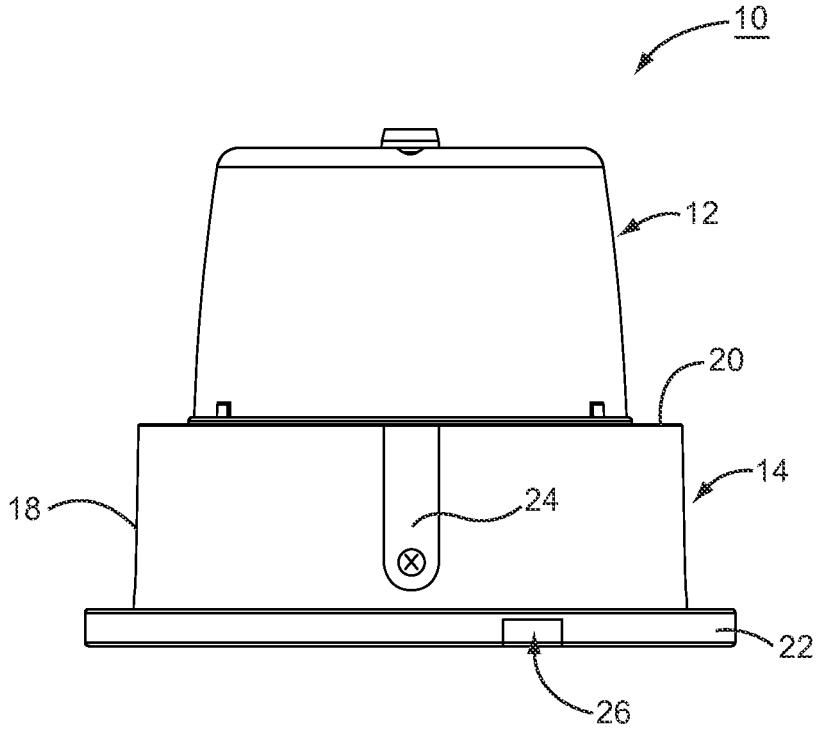
FIG. 3 is a side plan view of the lighting fixture of FIG. 1.

With reference to FIGS. 1-3, a lighting fixture 10 is illustrated according to one embodiment of the present disclosure. As shown, the lighting fixture 10 includes a control module 12, a heat spreading cup 14, and a lens assembly 16. A light source (not shown), which will be described in detail further below, is mounted inside the heat spreading cup 14 and oriented such that light is emitted from the heat spreading cup through the lens assembly 16. The electronics (not shown) that are required to power and drive the light source are provided, at least in part, by the control module 12. While the lighting fixture 10 is envisioned to be used predominantly in 4, 5, and 6 inch recessed lighting applications for industrial, commercial, and residential applications, those skilled in the art will recognize the concepts disclosed herein are applicable to virtually any size and application.

The lens assembly 16 may include one or more lenses that are made of clear or transparent materials, such as polycarbonate or acrylic. The lens assembly 16 may include a diffuser for diffusing the light emanated from the light source and exiting the heat spreading cup 14 via the lens assembly 16. Further, the lens assembly 16 may also be configured to shape or direct the light exiting the heat spreading cup 14 via the lens assembly 16 in a desired manner.

The control module 12 and the heat spreading cup 14 may be integrated and provided by a single structure. Alternatively, the control module 12 and the heat spreading cup 14 may be modular wherein different sizes, shapes, and types of control modules 12 may be attached, or otherwise connected, to the heat spreading cup 14 and used to drive the light source provided therein.

The heat spreading cup 14 is made of a material that provides good thermal conductivity, such as metal, ceramic, or the like. In the disclosed embodiment, the heat spreading cup 14 is formed from aluminum, but other metals, or thermally conductive materials, are applicable. Lighting fixtures, such as the illustrated lighting fixture 10, are particularly beneficial for recessed lighting applications wherein most, if not all of the lighting fixture 10 is recessed into a cavity within a wall, ceiling, cabinet, or like structure. Heat generated by the light source or electronics of the control module 12 is often trapped within the cavity. After prolonged operation, even an efficient lighting fixture 10 can cause sufficient heat to be trapped in the cavity, which may cause damage to the lighting fixture 10 itself or its surroundings.

Historically, fixture designers have placed heat sinks near the rear of lighting fixtures in an effort to transfer heat away from the light source or control electronics. Unfortunately, transferring heat toward the rear of the lighting fixtures effectively transfers the heat directly into the cavity in which the lighting fixture is mounted. As a result, the cavity heats up to a point where the heat sink no longer functions to transfer heat from the control electronics or light source, and damage to the lighting fixture ensues.

Instead of directing heat transfer toward the rear of the lighting fixture 10 and into the cavity in which the lighting fixture 10 is mounted, the lighting fixture 10 of the present disclosure employs the heat spreading cup 14 to direct heat transfer toward the front of the lighting fixture 10. Even when mounted into a cavity, the front of the lighting fixture 10 is either exposed to ambient, or in select embodiments, coupled to a mounting can that is also exposed to ambient. By directing heat transfer toward the front of the lighting fixture 10, the amount of heat that would otherwise be directed into the cavity in which the lighting fixture 10 is mounted is significantly reduced. By reducing the amount of heat directed toward the rear of the lighting fixture 10, the performance and longevity of the lighting fixture 10 may be enhanced, the number of acceptable mounting conditions and applications may be increased, the cost of the lighting fixture 10 may be reduced by being able to use less expensive components, or any combination thereof.

In the illustrated embodiment, the heat spreading cup 14 is cup-shaped and includes a sidewall 18 that extends between a bottom panel 20 at the rear of the heat spreading cup 14, and a rim, which may be provided by an annular flange 22 at the front of the heat spreading cup 14. One or more elongated slots 24 may be formed in the outside surface of the sidewall 18. As illustrated, there are two elongated slots 24, which extend parallel to a central axis of the lighting fixture 10 from the rear surface of the bottom panel 20 toward, but not completely to, the annular flange 22. The elongated slots 24 may be used for a variety of purposes, such as providing a channel for a grounding wire that is connected to the heat spreading cup 14 inside the elongated slot 24, connecting additional elements to the lighting fixture 10, or as described further below, securely attaching the lens assembly 16 to the heat spreading cup 14.

The annular flange 22 may include one or more mounting recesses 26 in which mounting holes are provided. The mounting holes may be used for mounting the lighting fixture 10 to a mounting structure or for mounting accessories to the lighting fixture 10. The mounting recesses 26 provide for counter-sinking the heads of bolts, screws, or other attachment means below or into the front surface of the annular flange 22.

Figure 4:
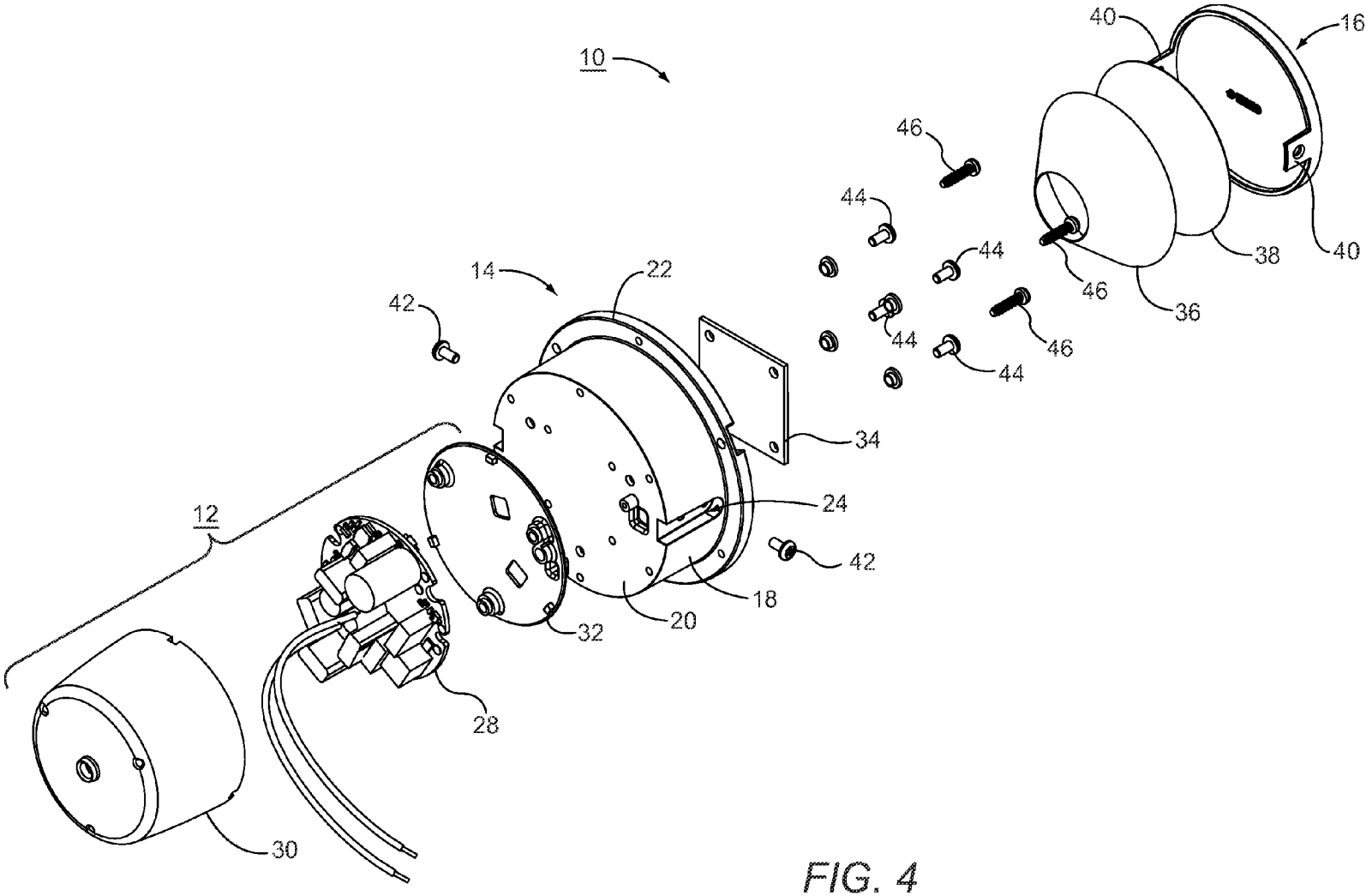
FIG. 4 is an exploded isometric view of the lighting fixture of FIG. 1.

With reference to FIG. 4, an exploded view of the lighting fixture 10 of FIGS. 1-3 is provided. As illustrated, the control module 12 includes control module electronics 28, which are encapsulated by a control module housing 30 and a control module cover 32. The control module housing 30 is cup-shaped and sized sufficiently to receive the control module electronics 28. The control module cover 32 provides a cover that extends substantially over the opening of the control module housing 30. Once the control module cover 32 is in place, the control module electronics 28 are contained within the control module housing 30 and the control module cover 32. The control module 12 is, in the illustrated embodiment, mounted to the rear surface of the bottom panel 20 of the heat spreading cup 14.

The control module electronics 28 may be used to provide all or a portion of power and control signals necessary to power and control the light source 34, which may be mounted on the front surface of the bottom panel 20 of the heat spreading cup 14. Aligned holes or openings in the bottom panel 20 of the heat spreading cup 14 and the control module cover 32 are provided to facilitate an electrical connection between the control module electronics 28 and the light source 34. In the illustrated embodiment, the light source 34 is solid state and employs one or more light emitting diodes (LEDs) and associated electronics, which are mounted to a printed circuit board (PCB) to generate light at a desired magnitude and color temperature. The LEDs are mounted on the front side of the PCB while the rear side of the PCB is mounted to the front surface of the bottom panel 20 of the heat spreading cup 14 directly or via a thermally conductive pad (not shown). The thermally conductive pad has a low thermal resistivity, and therefore, efficiently transfers heat that is generated by the light source 34 to the bottom panel 20 of the heat spreading cup 14. While an LED-based light source is the focus herein, other lighting technologies, such as but not limited to high-intensity discharge (HID) bulbs, readily benefit from the disclosed concepts.

While various mounting mechanisms are available, the illustrated embodiment employs four bolts 44 to attach the PCB of the light source 34 to the front surface of the bottom panel 20 of the heat spreading cup 14. The bolts 44 screw into threaded holes provided in the front surface of the bottom panel 20 of the heat spreading cup 14. Three bolts 46 are used to attach the heat spreading cup 14 to the control module 12. In this particular configuration, the bolts 46 extend through corresponding holes provided in the heat spreading cup 14 and the control module cover 32 and screw into threaded apertures (not shown) provided just inside the rim of the control module housing 30. As such, the bolts 46 effectively sandwich the control module cover 32 between the heat spreading cup 14 and the control module housing 30.

A reflector cone 36 resides within the interior chamber provided by the heat spreading cup 14. In the illustrated embodiment, the reflector cone 36 has a conical wall that extends between a larger front opening and a smaller rear opening. The larger front opening resides at and substantially corresponds to the dimensions of the front opening in the heat spreading cup 14 that corresponds to the front of the interior chamber provided by the heat spreading cup 14. The smaller rear opening of the reflector cone 36 resides about and substantially corresponds to the size of the LED or array of LEDs provided by the light source 34. The front surface of the reflector cone 36 is generally, but not necessarily, highly reflective in an effort to increase the overall efficiency of the lighting fixture 10. In one embodiment, the reflector cone 36 is formed from metal, paper, a polymer, or a combination thereof. In essence, the reflector cone 36 provides a mixing chamber for light emitted from the light source 34, and as described further below, may be used to help direct or control how the light exits the mixing chamber through the lens assembly 16.

Figure 5:
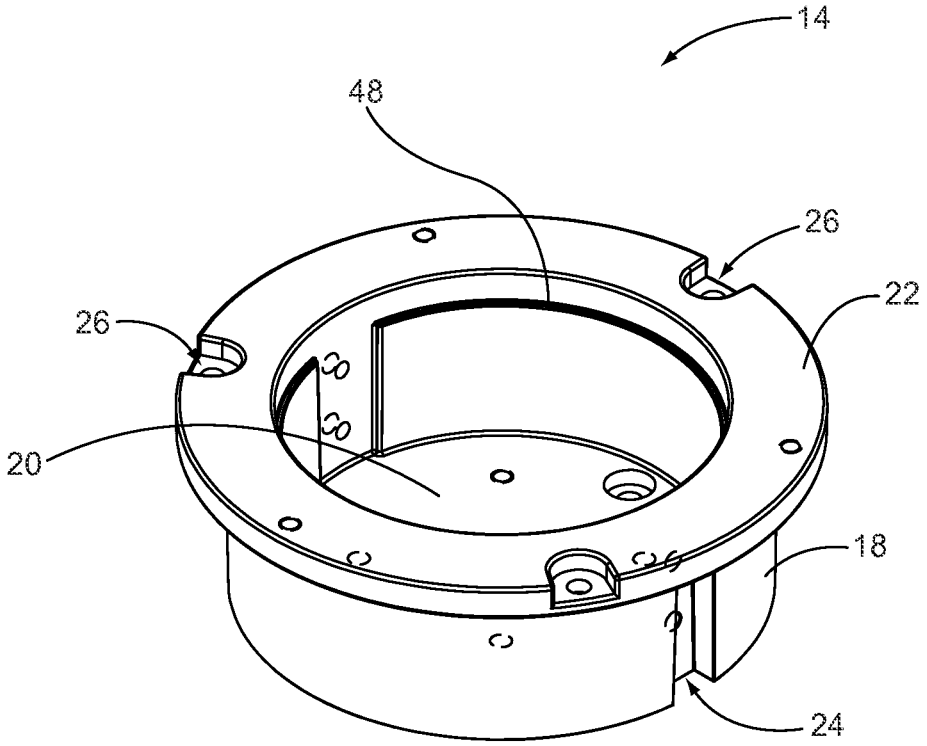
FIG. 5 is an isometric view of the front of the heat spreading cup of the lighting fixture of FIG. 1.
Figure 6:
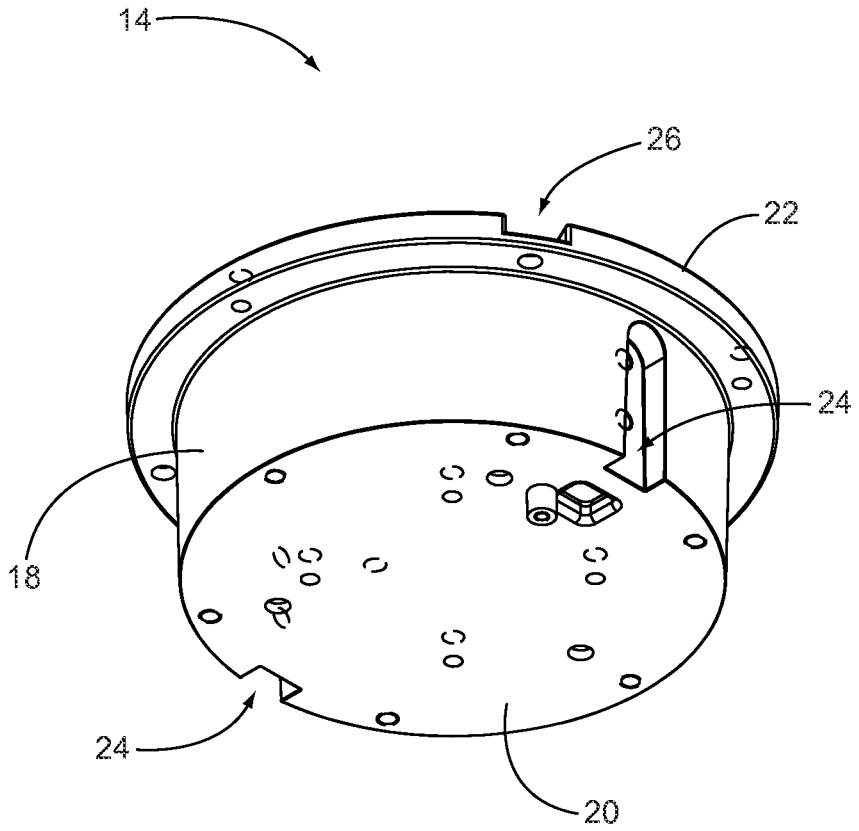
FIG. 6 is an isometric view of the rear of the heat spreading cup of the lighting fixture of FIG. 1.

When assembled, the lens assembly 16 is mounted on or to the annular flange 22 and may be used to hold the reflector cone 36 in place within the interior chamber of the heat spreading cup 14 as well as hold additional lenses and one or more diffusers 38 in place. It should be noted that in alternative embodiments, a diffuser 38 may be mounted between a rim provided by the annular flange 22 and the lens assembly 16. In the illustrated embodiment, the lens assembly 16 and the diffuser 38 generally correspond in shape and size to the front opening of the heat spreading cup 14 and are mounted such that the front surface of the lens is substantially flush with the front surface of the annular flange 22. As shown in FIGS. 5 and 6, a recess 48 is provided on the interior surface of the sidewall 18 and substantially around the opening of the heat spreading cup 14. The recess 48 provides a ledge on which the diffuser 38 and the lens assembly 16 rest inside the heat spreading cup 14. The recess 48 may be sufficiently deep such that the front surface of the lens assembly 16 is flush with the front surface of the annular flange 22.

Returning to FIG. 4, the lens assembly 16 may include tabs 40, which extend rearward from the outer periphery of the lens assembly 16. The tabs 40 may slide into corresponding channels on the interior surface of the sidewall 18 (see FIGS. 5 and 7). The channels are aligned with corresponding elongated slots 24 on the exterior of the sidewall 18. The tabs 40 have threaded holes that align with holes provided in the grooves and elongated slots 24. When the lens assembly 16 resides in the recess 48 at the front opening of the heat spreading cup 14, the holes in the tabs 40 will align with the holes in the elongated slots 24. Bolts 42 may be inserted through the holes in the elongated slots and screwed into the holes provided in the tabs 40 to affix the lens assembly 16 to the heat spreading cup 14. When the lens assembly 16 is secured, the diffuser 38 is sandwiched between the lens assembly and the recess 48, and the reflector cone 36 is contained between the diffuser 38 and the light source 34.

The degree and type of diffusion provided by the diffuser 38 may vary from one embodiment to another. Further, color, translucency, or opaqueness of the diffuser 38 may vary from one embodiment to another. Diffusers 38 are typically formed from a polymer or glass, but other materials are viable. Similarly, the lens assembly 16 includes a planar lens, which generally corresponds to the shape and size of the diffuser 38 as well as the front opening of the heat spreading cup 14. As with the diffuser 38, the material, color, translucency, or opaqueness of the lens or lenses provided by the lens assembly 16 may vary from one embodiment to another. Further, both the diffuser 38 and the lens assembly 16 may be formed from one or more materials or one or more layers of the same or different materials. While only one diffuser 38 and one lens (in lens assembly 16) are depicted, the lighting fixture 10 may have multiple diffusers 38 or lenses; no diffuser 38; no lens; or an integrated diffuser and lens (not shown) in place of the illustrated diffuser 38 and lens.

Figure 7:
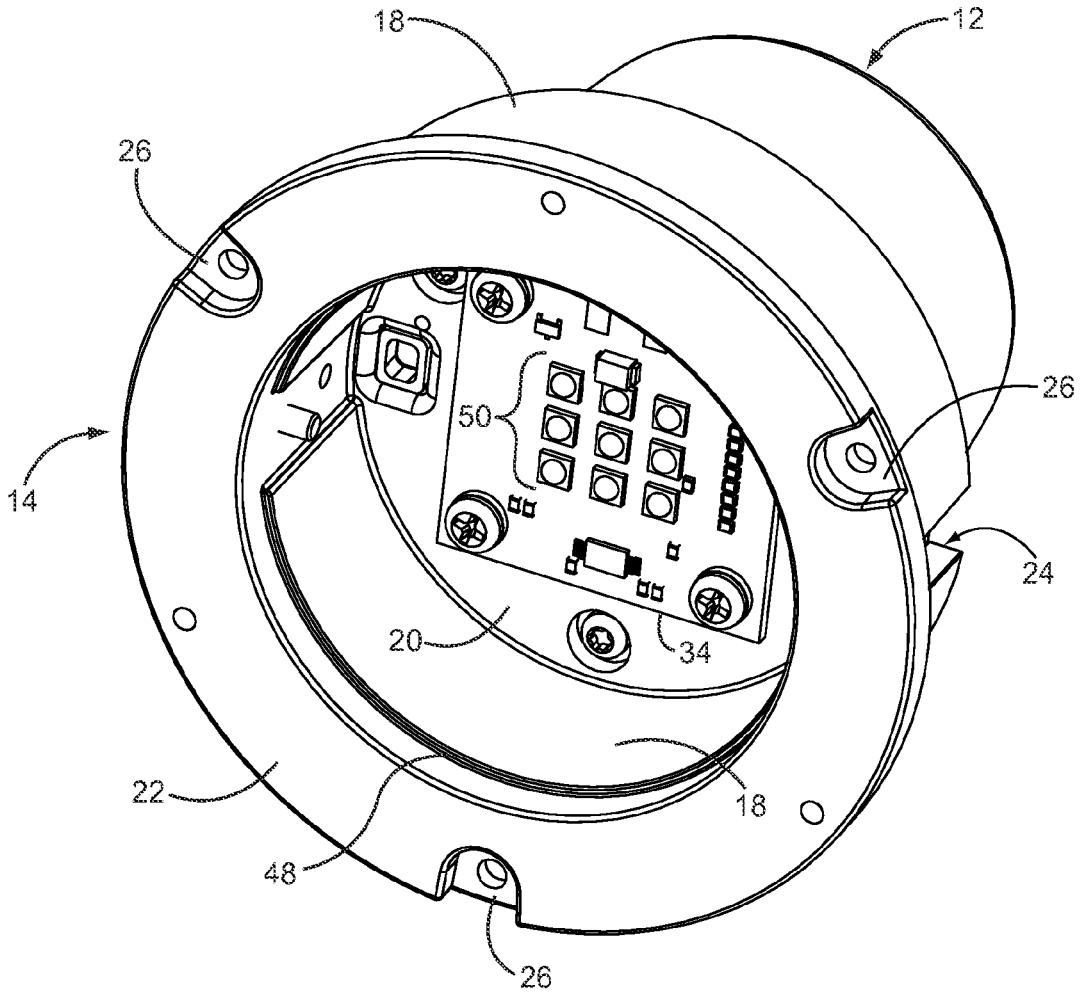
FIG. 7 is an isometric view of the front of the lighting fixture of FIG. 1 without the lens assembly, diffuser, and reflector.

For LED-based applications, the light source 34 provides an array of LEDs 50, as illustrated in FIG. 7. FIG. 7 illustrates a front isometric view of the lighting fixture 10, with the lens assembly 16, diffuser 38, and reflector cone 36 removed. Light emitted from the array of LEDs 50 is mixed inside the mixing chamber formed by the reflector cone 36 (not shown) and directed out through the lens assembly 16 in a forward direction to form a light beam. The array of LEDs 50 of the light source 34 may include LEDs 50 that emit different colors of light. For example, the array of LEDs 50 may include both red LEDs 50 that emit red light and blue-shifted green LEDs 50 that emit bluish-green light, wherein the red and bluish-green light is mixed to form "white" light at a desired color temperature. For a uniformly colored light beam, relatively thorough mixing of the light emitted from the array of LEDs 50 is desired. Both the mixing chamber provided by the reflector cone 36 and the diffuser 38 play a role in mixing the light emanated from the array of LEDs 50 of the light source 34.

Certain light rays, which are referred to as non-reflected light rays, emanate from the array of LEDs 50 and exit the mixing chamber through the diffuser 38 and lens assembly 16 without being reflected off of the interior surface of the reflector cone 36. Other light rays, which are referred to as reflected light rays, emanate from the array of LEDs of the light source 34 and are reflected off of the front surface of the reflector cone 36 one or more times before exiting the mixing chamber through the diffuser 38 and lens assembly 16. With these reflections, the reflected light rays are effectively mixed with each other and at least some of the non-reflected light rays within the mixing chamber before exiting the mixing chamber through the diffuser 38 and the lens assembly 16.

As noted above, the diffuser 38 functions to diffuse, and as result mix, the non-reflected and reflected light rays as they exit the mixing chamber, wherein the mixing chamber and the diffuser 38 provide sufficient mixing of the light emanated from the array of LEDs 50 of the light source 34 to provide a light beam of a consistent color. In addition to mixing light rays, the diffuser 38 may be designed and the reflector cone 36 shaped in a manner to control the relative concentration and shape of the resulting light beam that is projected from the lighting fixture 10. For example, a first lighting fixture 10 may be designed to provide a concentrated beam for a spotlight, wherein another may be designed to provide a widely dispersed beam for a floodlight.

Figure 8:
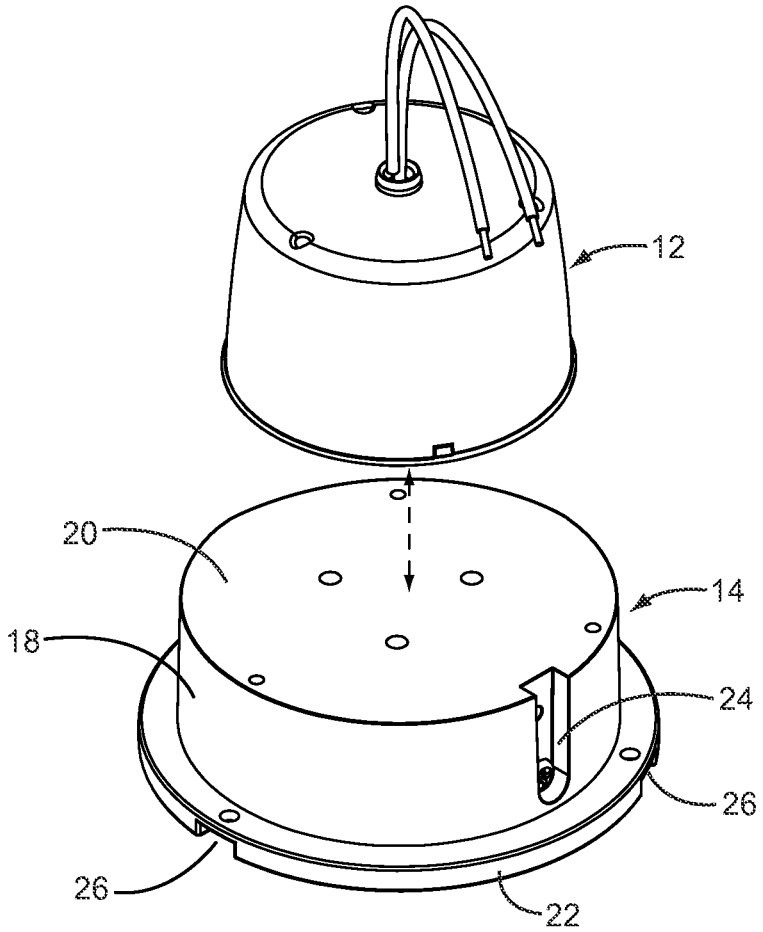
FIG. 8 illustrates the separation of the control module and heat spreading cup of the lighting fixture.

In select embodiments, the lighting fixture 10 is designed to work with different types of control modules 12 wherein different control modules 12 may interchangeably attach to the heat spreading cup 14, and can be used to drive the light source 34 provided in the heat spreading cup 14. As illustrated in FIG. 8, the control module 12 is readily attached to and detached from the heat spreading cup 14 wherein plugs or apertures are provided in each device to facilitate the necessary electrical connection between the two devices. As such, different manufactures are empowered to design and manufacture control modules 12 for another manufacture's heat spreading cup 14 and light source 34 assembly, and vice versa. Further, different sizes, shapes, and sizes of control modules 12 may be manufactured for a given heat spreading cup 14 and light source 34 assembly, and vice versa.

Figure 9:
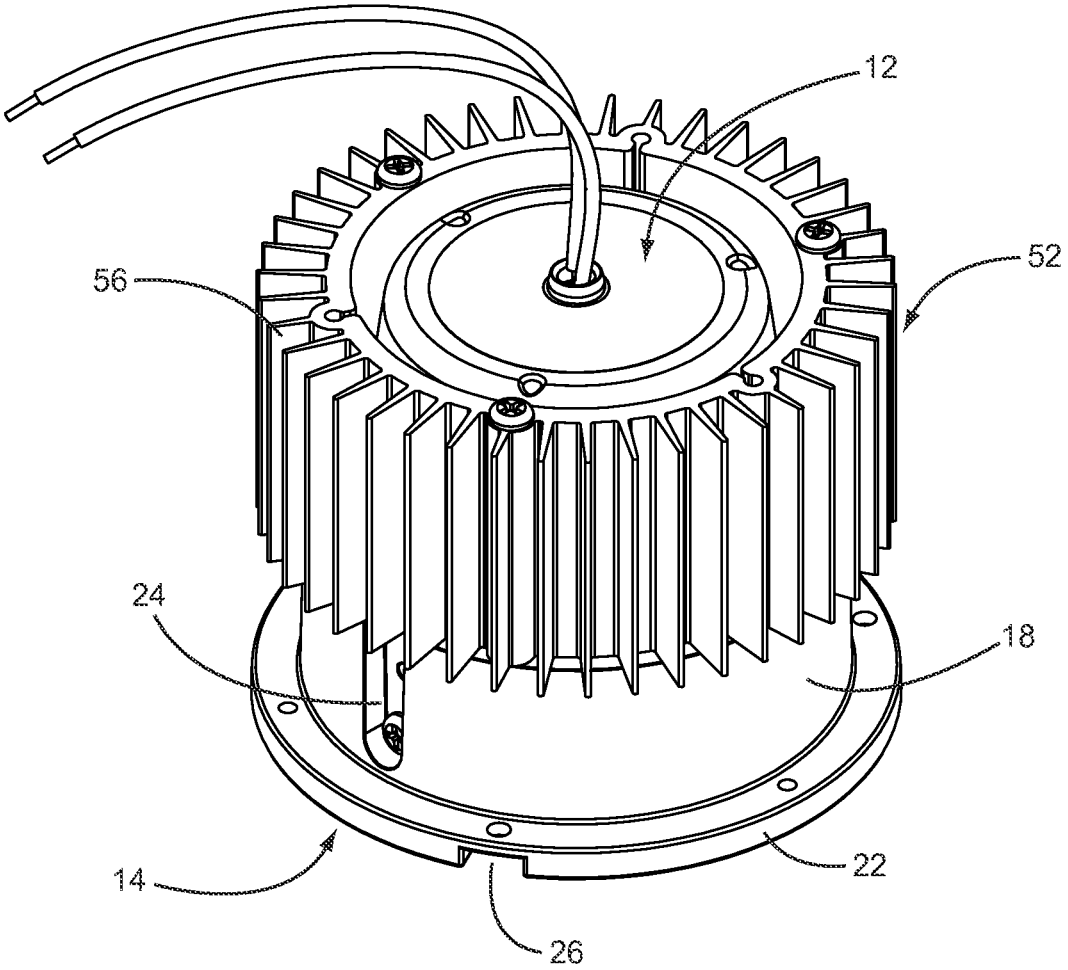
FIG. 9 is an isometric view of the rear of the lighting fixture of FIG. 1 with an optional heat sink.
Figure 10:
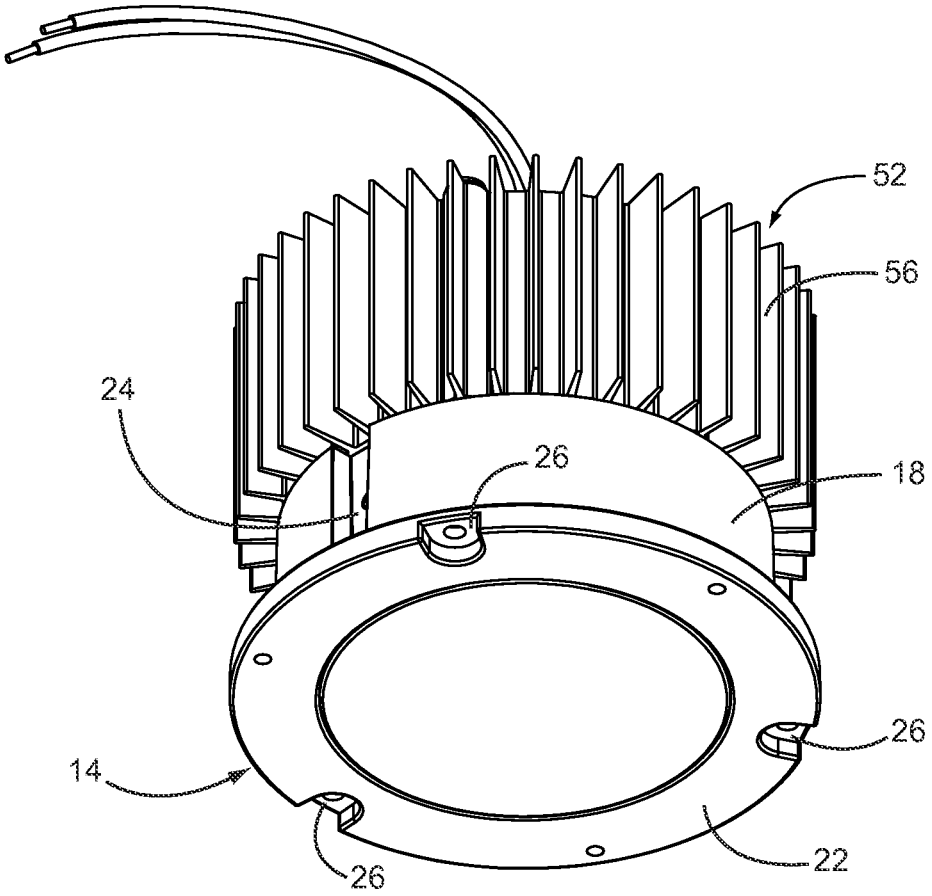
FIG. 10 is an isometric view of the front of the heat spreading cup of the lighting fixture of FIG. 1 with an optional heat sink.

With reference to FIGS. 9 and 10, an optional heat sink 52 may be provide for the lighting fixture 10. In the illustrated embodiment, the heat sink 52 is substantially cylindrical and provides an interior opening that is sized to receive the control module 12 and rest against an outer portion of the rear surface of the bottom panel 20 of the heat spreading cup 14. The heat sink 52 includes radial fins 56 that are substantially parallel to the central axis of the lighting fixture 10. A thermally conductive pad or other material may be provided between the heat sink 52 and the heat spreading cup 14 to enhance the thermal coupling of the heat sink 52 and the heat spreading cup 14.

Without the heat sink 52, most of the heat generated by the control module electronics 28 and the light source 34 is transferred outward to the sidewall 18 via the bottom panel 20 of the heat spreading cup 14, and then forward along the sidewall 18 to the front of the lighting fixture 10. As such, a significant amount, if not a majority, of the heat is transferred to the front of the lighting fixture 10, instead of being transferred to the rear of the lighting fixture where it may be trapped within the cavity in which the lighting fixture is mounted. In embodiments where the heat sink 52 is provided, a certain amount of the heat that is transferred outward along the bottom panel 20 of the heat spreading cup 22 will be transferred rearward to the heat sink 52 while a certain amount of the heat is transferred forward along the sidewall 18.

Figure 11:
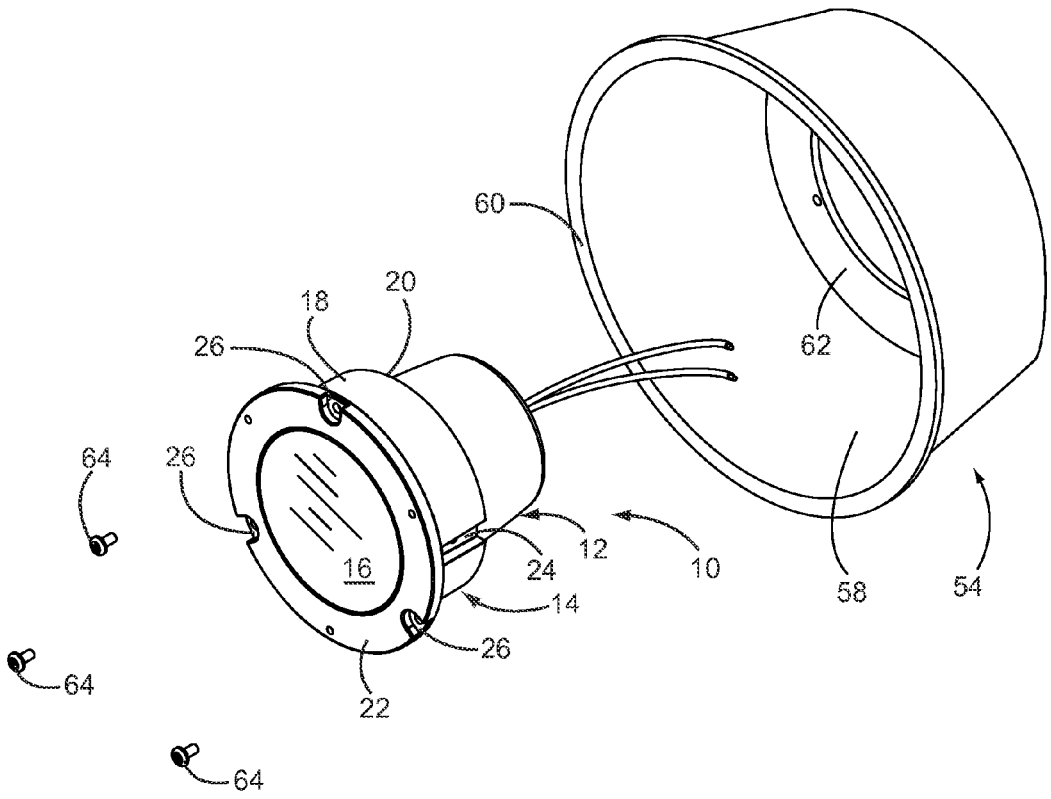
FIG. 11 is an exploded isometric view of the lighting fixture of FIG. 1 and a mounting can.
Figure 13:
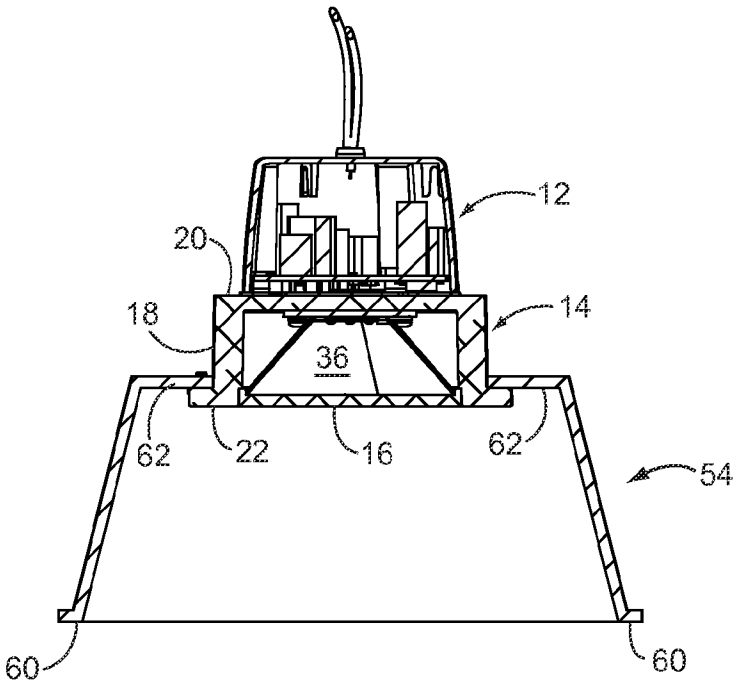
FIG. 13 is a cross sectional view of the assembly of FIG. 11 along line A-A illustrated in FIG. 12.
Figure 12:
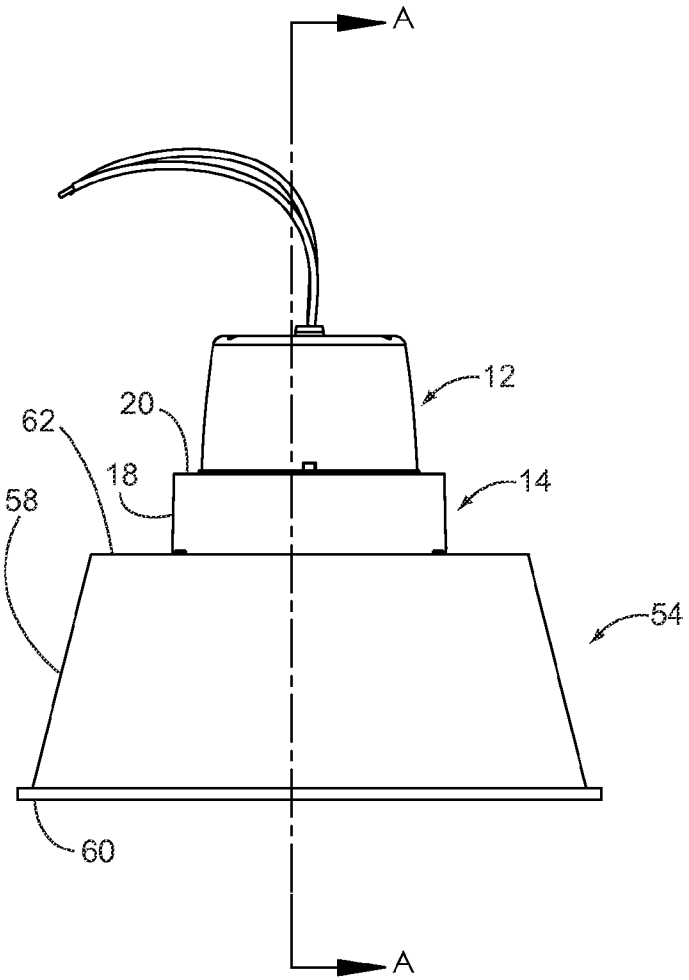
FIG. 12 is a side plan view of the assembly of FIG. 11.

The lighting fixture 10 may be used in conjunction with any number of accessories. An exemplary accessory, such as a mounting can 54, is shown in FIGS. 11-13. In the illustrated embodiment, the mounting can 54 has a substantially cylindrical sidewall 58 extending between a forward edge 60 and an annular flange 62. The annular flange 62 has a circular opening that is slightly larger in diameter than the sidewall 18 of the heat spreading cup 14 while smaller in diameter than the outside periphery of the annular flange 22 of the heat spreading cup 14. As illustrated in FIGS. 12 and 13, the lighting fixture 10 is mounted in the mounting can 54 such that the control module 12 and the rear portion of the heat spreading cup 14 extend through the opening in the annular flange 62 of the mounting can 54. In particular, the rear surface of the annular flange 22 of the heat spreading cup 14 rests against the front surface of the annular flange 62 of the mounting can 54. Bolts 64 may be used to attach the heat spreading cup 14, and thus the entirety of the lighting fixture 10, to the annular flange 62 of the mounting can 54. The bolts 64 extend through holes provided in the recesses 26 and screw into threaded holes provided in the annular flange 62 of the mounting can 54.

As noted above, the heat spreading cup 14 functions to transfer heat that is generated from the light source 34 and the control module electronics 28 forward toward and to the annular flange 22. As a result, the heat is transferred toward ambient and away from the cavity into which the rear of the lighting fixture 10 extends. If the mounting can 54 is of a material that conducts heat, the heat transfer from the light source 34 and the control module electronics 28 may be further transferred from the annular flange 22 of the heat spreading cup 14 to the annular flange 62 of the mounting can 54. Once transferred to the annular flange 62, the heat is transferred outward to the sidewall 58 and then forward along the sidewall 58 toward the lip 60 of the mounting can 54. In essence, the mounting can 54 may operate as a heat spreading extension to the heat spreading cup 14 of the lighting fixture 10. To act as a heat spreading extension, the mounting can 54 may be made of a material with a low thermal resistivity, such as copper, thermally conductive plastic or polymer, aluminum, or an aluminum alloy.

Figure 14:
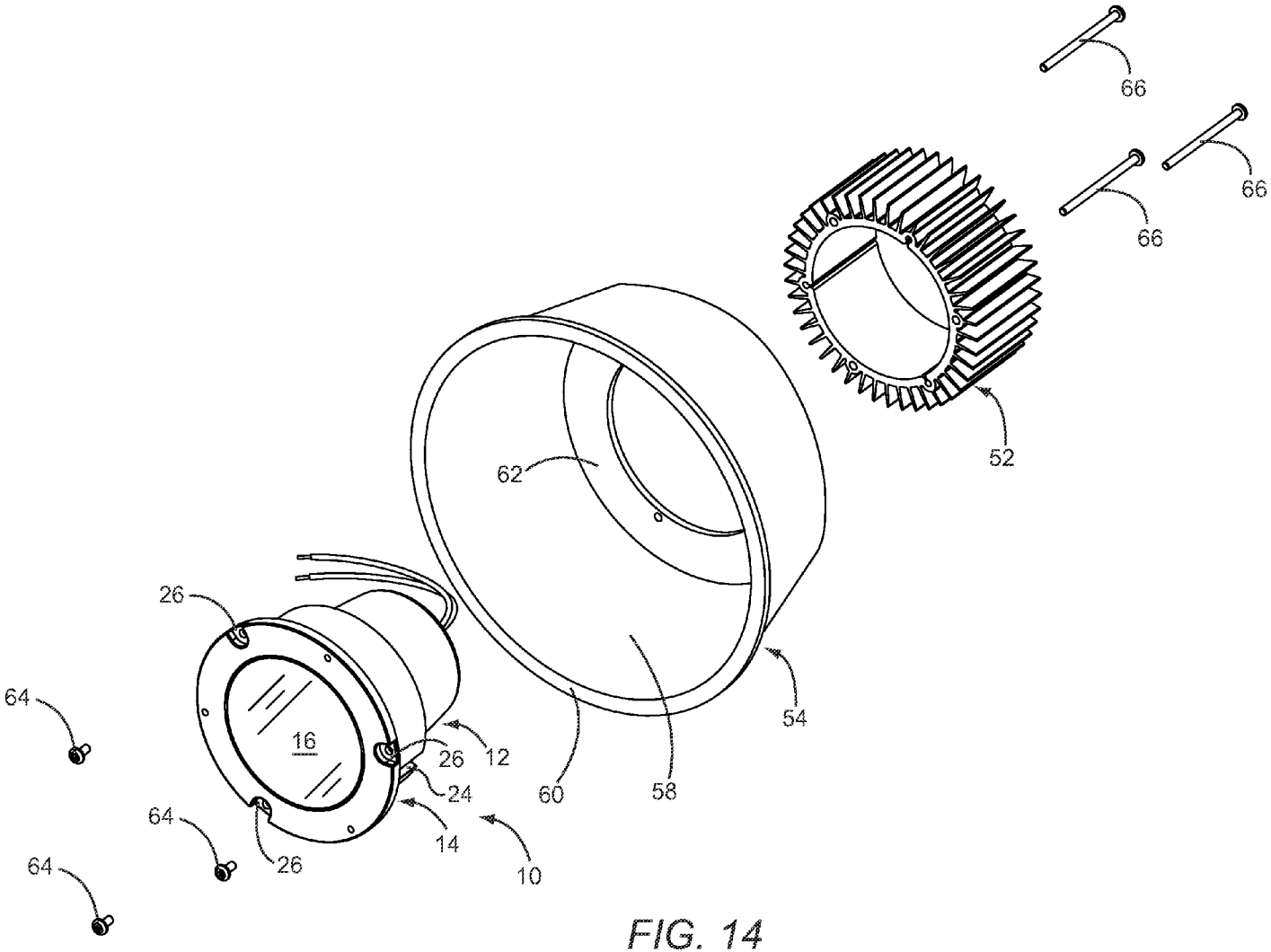
FIG. 14 is an exploded isometric view of the lighting fixture of FIG. 1, a mounting can, and a heat sink.
Figure 15:
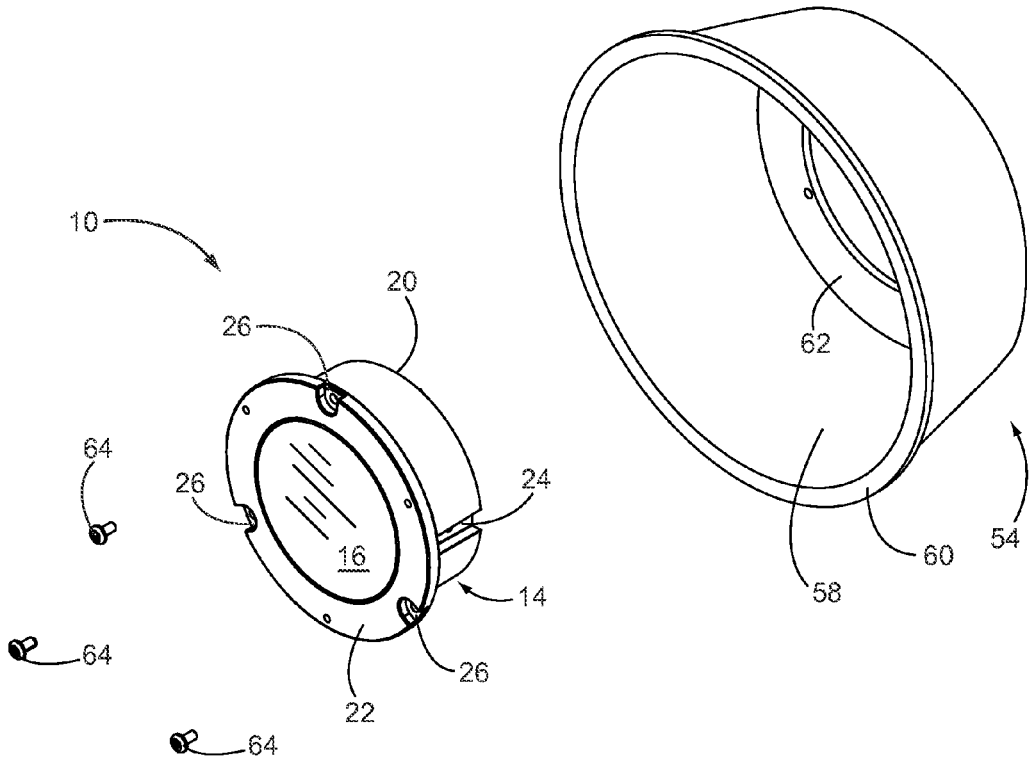
FIG. 15 is an exploded isometric view of the lighting fixture of FIG. 1 without the control module and with a mounting can.

FIG. 14 provides an exploded isometric view of an alternative embodiment wherein the heat sink 52 is attached to the lighting fixture 10 and mounting can 54 assembly of FIGS. 11-13. The bolts 66 extend through holes provided in the heat sink 52 and screw into threaded holes provided in the annular flange 62 of the mounting can 54. FIG. 15 provides an exploded isometric view of yet another alternative embodiment wherein the lighting fixture 10 in the assembly illustrated in FIGS. 11-13 is not provided with the control module 12.

Those skilled in the art will recognize improvements and modifications to the embodiments of the present disclosure. All such improvements and modifications are considered within the scope of the concepts disclosed herein.

The invention claimed is:

1. A lighting fixture comprising:

a heat spreading cup having a bottom panel integral with the heat spreading cup, a rim, and at least one sidewall extending between the bottom panel and the rim;

a light source coupled to an interior surface of the bottom panel and inside the heat spreading cup, the light source being configured to emit light in a forward direction through an opening formed by the rim, wherein the light source is thermally coupled to the bottom panel such that heat generated by the light source during operation is transferred radially outward along the bottom panel and in the forward direction along the at least one sidewall toward the rim;

a control module having electronics to control the light source and coupled to an exterior surface of the bottom panel opposite the interior surface; and a heat sink coupled to the exterior surface of the bottom panel opposite the light source, wherein the heat sink has an interior opening in which the control module is received once the heat sink is coupled to the exterior surface of the bottom panel.

2. The lighting fixture of claim 1 further comprising a lens assembly coupled to the heat spreading cup and covering the opening provided by the rim.

3. The lighting fixture of claim 2 wherein the lens assembly comprises a lens portion and at least one tab that is coupled to the heat spreading cup.

4. The lighting fixture of claim 3 wherein the at least one tab is coupled to an interior surface of the at least one sidewall of the heat spreading cup.

5. The lighting fixture of claim 4 wherein the lens portion is substantially perpendicular to a central axis of the heat spreading cup and the at least one tab is substantially parallel to the central axis.

6. The lighting fixture of claim 5 wherein the interior surface of the at least one sidewall comprises at least one channel in which the at least one tab is received.

7. The lighting fixture of claim 6 further comprising an attachment implement and wherein the at least one channel further comprises a first hole that extends through the at least one sidewall and aligns with a second hole in the at least one tab when the lens assembly is in place, the attachment implement extending through the first hole and into the second hole to hold the lens assembly in place.

8. The lighting fixture of claim 7 wherein an exterior surface of the at least one sidewall comprises at least one elongated slot substantially aligned with the at least one channel and the first hole resides in the at least one elongated slot.

9. The lighting fixture of claim 1 further comprising a reflector having a body extending between a smaller opening substantially adjacent and about a light emitting element of the light source and a larger opening biased toward the opening formed by the rim.

10. The lighting fixture of claim 9 further comprising a diffuser mounted between the rim and the lens assembly.

11. The lighting fixture of claim 9 wherein the reflector is conical.

12. The lighting fixture of claim 11 wherein the reflector is formed from paper.

13. The lighting fixture of claim 9 wherein the light emitting element of the light source comprises a light emitting diode.

14. The lighting fixture of claim 9 wherein the light emitting element comprises an array of light emitting diodes.

15. The lighting fixture of claim 1, wherein heat generated by the electronics during operation is transferred radially outward along the bottom panel and in the forward direction along the at least one sidewall toward the rim.

16. The lighting fixture of claim 15 wherein a majority of the heat that is generated from the electronics and the light source and transferred to the bottom panel is transferred radially outward along the bottom panel and in the forward direction along the at least one sidewall toward the rim.

17. The lighting fixture of claim 1 further comprising a mounting can comprising a panel having an opening receiving the rim of the heat spreading cup, a forward rim, and at least one sidewall extending between the panel and the forward rim, wherein the panel is coupled to the rim of the heat spreading cup and the heat transferred from the light source to the rim of the heat spreading cup is further transferred in the forward direction along the at least one sidewall of the mounting can.

18. The lighting fixture of claim 17 wherein the heat spreading cup and the mounting can are formed from at least one of a metal and a ceramic.

19. The lighting fixture of claim 1 wherein the heat spreading cup is formed from at least one of a metal and a ceramic.

20. The lighting fixture of claim 1 wherein the rim is substantially annular and the at least one sidewall is substantially cylindrical.

21. The lighting fixture of claim 1 wherein a majority of the heat that is generated from the light source and transferred to the bottom panel is transferred radially outward along the bottom panel and in the forward direction along the at least one sidewall toward the rim.

22. The lighting fixture of claim 21 wherein the rim is provided by a flange.

23. A lighting fixture comprising:

a heat spreading cup having a bottom panel integral with the heat spreading cup, a rim, and at least one sidewall extending between the bottom panel and the rim;

a light source coupled to an interior surface of the bottom panel and inside the heat spreading cup, the light source being configured to emit light in a forward direction through an opening formed by the rim wherein the light source is thermally coupled to the bottom panel such that heat generated by the light source during operation is transferred radially outward along the bottom panel and in the forward direction along the at least one sidewall toward the rim;

a lens assembly that is coupled to the heat spreading cup and covers the opening provided by the rim;

a reflector having a body extending between a smaller opening substantially adjacent and about a light emitting element of the light source and a larger opening biased toward the opening formed by the rim;

a control module having electronics to control the light source and coupled to an exterior surface of the bottom panel opposite the interior surface; and a heat sink coupled to the exterior surface of the bottom panel opposite the light source, wherein the heat sink has an interior opening in which the control module is received once the heat sink is coupled to the exterior surface of the bottom panel.

24. The lighting fixture of claim 23, wherein heat generated by the electronics during operation is transferred radially outward along the bottom panel and in the forward direction along the at least one sidewall toward the rim.

25. The lighting fixture of claim 24 wherein a majority of the heat that is generated from the electronics and the light source and transferred to the bottom panel is transferred radially outward along the bottom panel and in the forward direction along the at least one sidewall toward the rim.

26. The lighting fixture of claim 25 wherein the heat spreading cup is formed from at least one of a metal and a ceramic.

27. The lighting fixture of claim 26 wherein the rim is substantially annular, the at least one sidewall is substantially cylindrical, and the reflector is conical.

28. The lighting fixture of claim 27 wherein the light emitting element comprises an array of light emitting diodes.

29. The lighting fixture of claim 27 wherein the rim is provided by a flange.

30. A lighting fixture comprising:

a heat spreading cup having a front surface, an integral bottom panel, a rim, and at least one sidewall extending between the bottom panel and the rim, wherein the heat spreading cup is configured to receive a heat sink on at least one of the front surface and the bottom panel;

a light source coupled to an interior surface of the bottom panel and inside the heat spreading cup, the light source being configured to emit light in a forward direction through an opening formed by the rim, wherein the light source is thermally coupled to the bottom panel such that heat generated by the light source during operation is transferred radially outward along the bottom panel and in the forward direction along the at least one sidewall toward the rim;

a control module having electronics to control the light source and coupled to an exterior surface of the bottom panel opposite the interior surface; and a heat sink coupled to the exterior surface of the bottom panel opposite the light source, wherein the heat sink has an interior opening in which the control module is received once the heat sink is coupled to the exterior surface of the bottom panel.

* * * * *